US005639003A

United States Patent [19]

Utzinger, III

[11] Patent Number: 5,639,003

[45] Date of Patent: Jun. 17, 1997

[54] CONVERTIBLE LADDER CADDY AND TOOL BELT

[76] Inventor: Frederick J. Utzinger, III, 324 Jones St., Dayton, Ohio 45410

[21] Appl. No.: 390,402

[22] Filed: Feb. 16, 1995

[51] Int. Cl.[6] ..... A45C 9/00

[52] U.S. Cl. ..... 224/577; 224/904

[58] Field of Search ..... 224/151, 904, 224/226, 577, 660

[56] References Cited

U.S. PATENT DOCUMENTS

| | | | |
|---|---|---|---|
| D. 355,062 | 1/1995 | Maire et al. | D32/53 |
| 4,993,614 | 2/1991 | Bonofiglo | 224/904 |
| 5,337,933 | 8/1994 | Nunez | 225/151 |

OTHER PUBLICATIONS

JobBoss packaging, Portable Products, 1993.

*Primary Examiner*—Renee S. Luebke

*Attorney, Agent, or Firm*—Killworth, Gottman, Hagan & Schaeff

[57] ABSTRACT

The present invention is a portable tool carrying apparatus which can be used to conveniently and easily carry a variety of tools from one location to another and at the same time be safely secured to the top of a ladder. The present tool carrying apparatus includes a front panel and a back panel, with each panel having two sides, a top, a bottom and a face. At least the front panel has a plurality of tool receiving pockets disposed on its face. Preferably, the face of the back panel also includes at least one tool receiving pocket. These tool receiving pockets can be made to accommodate a number of the same or different types of tools. One side of the back panel is connected to one side of the front panel and the other side of the back panel is connected to the other side of the front panel so as to form a plurality of panels operatively adapted for being disposed around a top portion of a ladder. Structure is also provided which enables at least the front panel to be alternatively secured to a belt or around the top portion of a ladder, thereby making the present tool carrying apparatus convertible between being used as a ladder caddy and as a tool belt.

18 Claims, 2 Drawing Sheets

CONVERTIBLE LADDER CADDY AND TOOL BELT

FIELD OF THE INVENTION

The present invention is related to portable tool carrying apparatus, and more particularly to a portable tool carrying apparatus that is convertible from being used as a tool belt to being secured to the top of a ladder.

BACKGROUND OF THE INVENTION

People who build or repair things, whether the hobbyist or professional, often use a number of different tools for any given project. Sometimes the project can be performed in a work room or shop where their tools are stored. However, it is often necessary for the tools to be carried to a remote work site. For example, when portions of the inside or outside of a house, office or other building are to be built or are otherwise in need of repair, the appropriate tools have to be carried to the work site. Tool belts and other such portable tool carrying devices have been developed to make it easier to carry and organize all the tools used on the project.

A typical tool belt is made of some type of fabric or leather formed into a number of pockets of different sizes and shapes to accommodate a variety of tools. A belt is used to secure the pockets around the waist and in front of the person doing the work. Other portable tool carrying devices have included canvas bags with pockets of various sizes and shapes formed around the outside and/or inside of the bag. Some of these tool carrying bags are of typical tote bag construction, with two fabric loop handles and a zippered opening running along its length. Another type of tool carrying bag is designed for use with a standard 5 gallon bucket having a wire loop handle. This latter tool carrying bag has an inside tubular shaped panel with pockets formed on its inside surface and an outside tubular panel with pockets formed on its outside surface. The two panels are integrally joined along an upper circular crease. The inside panel and outside panel are positioned inside and outside of the bucket, respectively, with the circular crease resting on the upper rim of the bucket. Both of these tool bags are carried around by their corresponding handle, usually with one hand.

It is often necessary to work with tools from the top of a step ladder, for example, when repairing or installing a ceiling fixture and fixing or building a roof. The prior tool bags enable the necessary tools to be carried up the ladder at the same time. However, having to carry the bag of tools up the ladder can be awkward and result in the person losing balance. Once brought to the top of the ladder, the tool bag is either placed on the top rung of the ladder or on a separate platform which extends out from near the top of most step ladders. Either way, with it simply resting on the ladder, the bag of tools can be accidentally knocked over.

If a tool belt is used, the risk of the tools accidentally falling off of the ladder can be significantly reduced, if not eliminated, as long as the belt remains around the worker's waist. However, the added weight of the tools around their waist can be cumbersome and increase the risk of the person on the ladder losing their balance and falling, especially if the person stretches out over the ladder while working.

Therefore, there is a need for a portable tool carrying apparatus which can be used to conveniently and easily carry a variety of tools from one location to another and up and down a ladder, while at the same time be safely secured to the top of the ladder.

SUMMARY OF THE INVENTION

This need is satisfied by providing a tool carrying apparatus according to the principles of the present invention.

The present invention includes a front panel and a back panel, with each panel having two sides, a top, a bottom and a face. At least the front panel has a plurality of tool receiving pockets disposed on its face. Preferably, the face of the back panel also includes least one tool receiving pocket. These tool receiving pockets can be made to accommodate a number of the same or different types of tools. One side of the back panel is connected to one side of the front panel and the other side of the back panel is connected to the other side of the front panel so as to form a plurality of panels operatively adapted for being disposed around a top portion of a ladder. Structure is also provided which enables at least the front panel to be alternatively secured to a belt or around the top portion of a ladder, thereby making the present tool carrying apparatus convertible between being used as a ladder caddy and as a tool belt.

In one aspect of the present invention, one side of the front panel is connected to one side of the back panel by at least one connecting element and the other side of the front panel is connected to the other side of the back panel by at least one other connecting element. The back panel, front panel and side connecting elements are operatively adapted to define an opening suitable for receiving a top portion of a ladder. Each of these connecting elements can, for example, be one or more straps, or a side panel. The side panel has a face, two sides, a top and a bottom, with one side of each side panel being joined to one side of the front panel, and the other side of each side panel being joined to one side of the back panel. Preferably, the face of at least one of the side panels includes at least one tool receiving pocket.

The present tool carrying apparatus can be secured to the top of a ladder in a number of ways. For example, at least one strap can be used to connect the top of the front panel and the top of the back panel and extend across the top rung of the ladder to prevent the panels from sliding down. Alternatively, at least one top panel can be used to connect the tops of the front and back panels. Each top panel can be solid or made of criss-crossing straps or cords, etc. In one embodiment, each top panel has a carrying strap disposed on its face.

Each side panel and top panel is preferably foldable to allow the front panel to be adjacent the back panel when the apparatus is used as a tool belt. At least one fastener (e.g., snaps, a hook and loop fastener (e.g., VELCRO™), buttons, hooks, etc.) can be used to maintain each top panel in such a folded condition.

The present tool carrying apparatus can be secured to a belt in a number of ways. For example, two belt fasteners (e.g., two belt hooks, clamps, clips, snap loops, etc.) can be used, with one of the fasteners being disposed adjacent each side of the apparatus. Alternatively, the present apparatus can include at least one belt loop portion defining an opening through which the belt is disposed so as to extend from side-to-side across either the front or back panel and around the torso of a person when the apparatus is used as a tool belt. In this way, the present invention can be secured to and removed from a separate belt, including the worker's own belt. The belt can also be made part of the tool carrying apparatus itself, with a portion of the belt being fixed in some manner (e.g., sewn, glued, stapled, riveted, etc.) to at least one panel of the apparatus. The belt is preferably adapted so that it can be used as either a belt or a shoulder strap.

The objectives, features, and advantages of the present invention will become apparent upon consideration of the detailed description and the appended drawings.

DETAILED DESCRIPTION OF THE INVENTION

Although the present invention is herein described in terms of a specific embodiment, it will be readily apparent to those skilled in this art that various modifications, rearrangements, and substitutions can be made without departing from the spirit of the invention. The scope of the present invention is thus only limited by the claims appended hereto.

Figure 1:
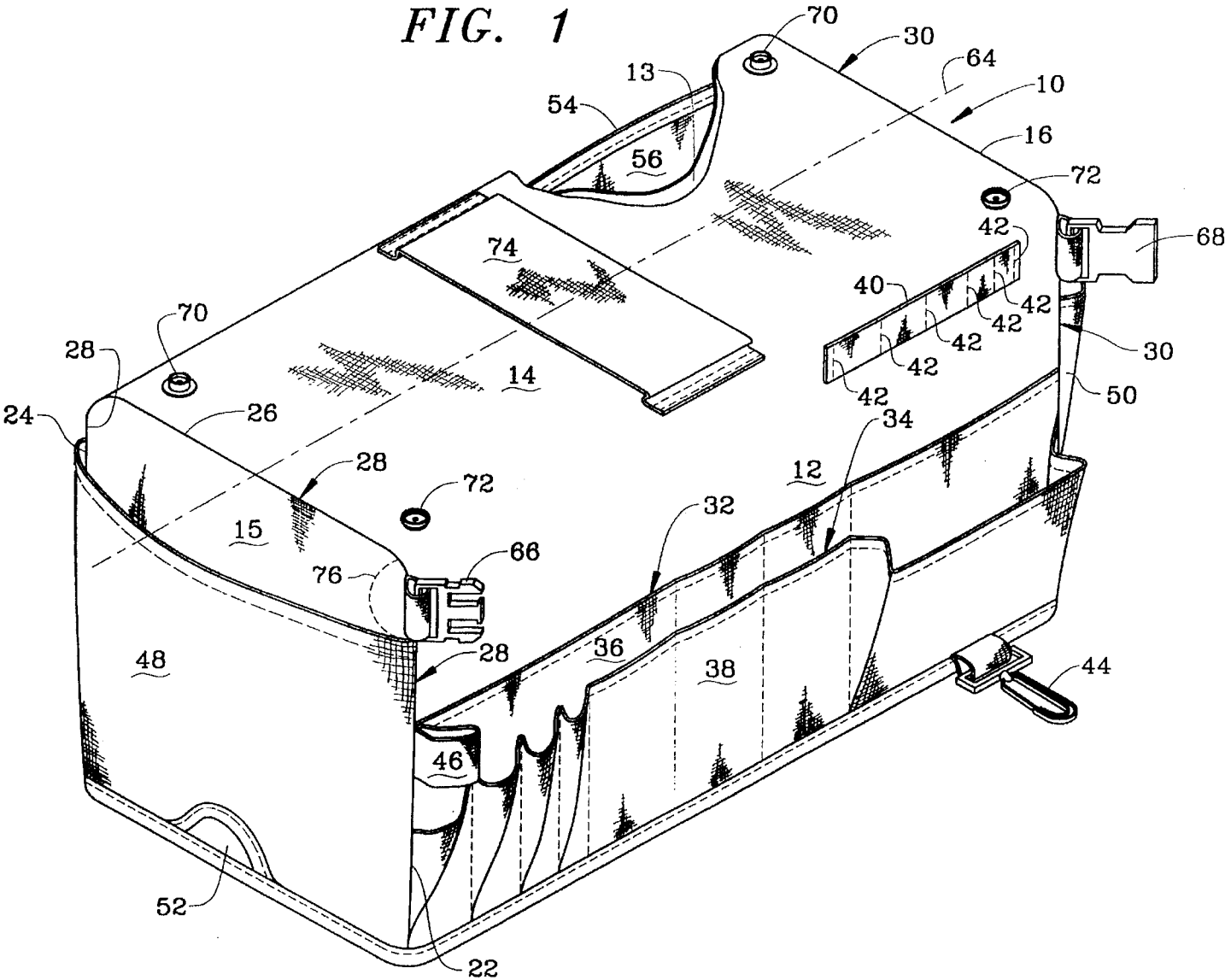
FIG. 1 is a partially broken away perspective view of one embodiment of the present portable tool carrying apparatus.

Referring to FIG. 1, one embodiment of a portable tool carrying apparatus 10 according to the principles of the present invention is preferably made of some type of heavy fabric, such as canvas, but may also be made of plastic sheet material, leather or any other suitable material. The tool carrying apparatus 10 includes a front panel 12 and a back panel 13. Each panel 12 and 13 has two sides, a top, a bottom and a face. The tops of the front and back panels 12 and 13 are integrally connected by a top panel 14 of the same heavy fabric forming panels 12 and 13. Alternatively, instead of the top panel 14, one or more top straps 11 can be used to connect the top of the front panel 12 and the top of the back panel 13. Apparatus 10 also includes a first and second side panel 15 and 16. The first side panel 15 has one side 22 joined to one side of the front panel, its other side 24 joined to one side of the back panel 13, and a top 26 joined to one end of the top panel 14, all along the same seam 28. The other side panel 16 is similarly joined to the front, back and top panels 12–14 along a seam 30. Alternatively, instead of the side panels 15 and 16, at least one side strap 29 can be used to connect one side of the front panel 12 to one side of the back panel 13, and at least one other side strap 29 can be used to connect the other side of the front panel 12 to the other side of the back panel 13. The panels 12–16 are disclosed as being sewn together along seams 28 and 30. However, they could also be joined together by any suitable way. For example, seams 28 and 30 could be formed by gluing, stapling, riveting, or otherwise permanently joining panels 12–16 together. Alternatively, it may be desirable for panels 12–16 to be joined using some form of fastener, for example a hook and loop fastener (e.g., VELCRO™), buttons, hooks, etc. With the panels 12–16 joined in this manner, the apparatus 10 has the appearance of an inverted rectangular shaped bag.

The front panel 12 has an upper and lower set of pockets 32 and 34 formed by two pieces of fabric 36 and 38, respectively, sewn onto the face of panel 12. Each set of pockets 32 and 34 includes pockets of different sizes and shapes to accommodate a variety of tools. An elastomeric strip 40 is also sewn onto the face of front panel 12 at spaced apart locations 42 along its length the distances vary between any two adjacent stitchings 42 (see FIG. 1). Strip 40 is used to elastically retain a number of different size drill bits on the face of the front panel 12. A utility hook 44 is sewn along the bottom of the front panel 12 and a loop 46 of fabric is sewn into the seam 28 on one side of the front panel 12.

Each side panel 15 and 16 has a single pocket 48 and 50 sewn thereover, respectively. The pocket 48 has an opening 52 formed at its bottom for receiving therethrough, for example, the handle of a hammer (not shown), the ruler on an adjustable T-square (not shown), or the like. The back panel 13 has two pockets 54 of equal size formed by a single piece of fabric 56 sewn onto the face of panel 13.

Figure 2:
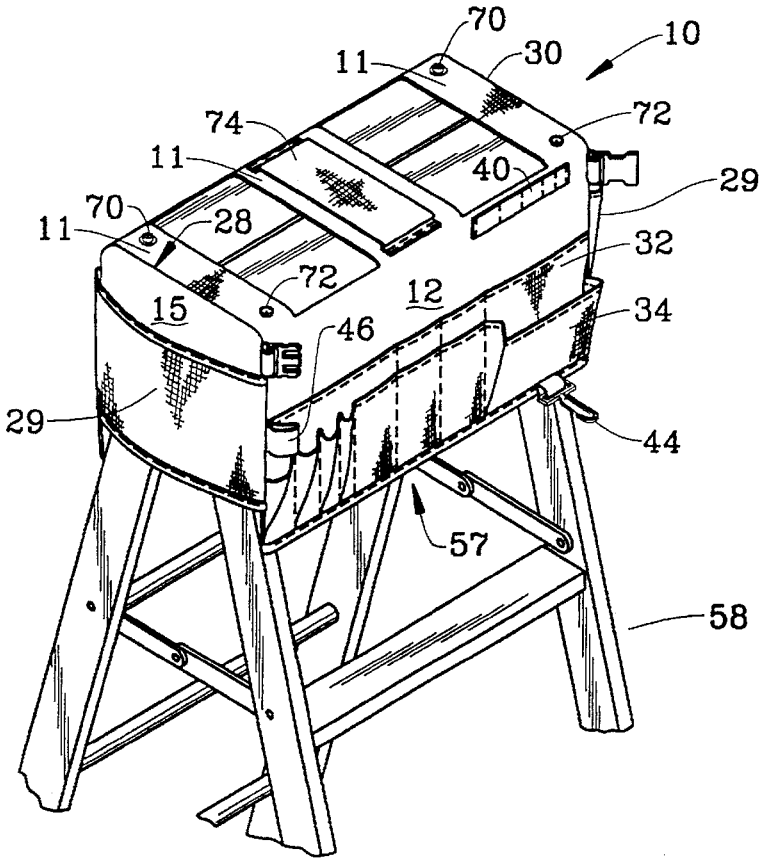
FIG. 2 is a perspective view of an alternative embodiment of the apparatus of FIG. 1, mounted on the top of a step ladder for use as a ladder caddy.

Referring to FIG. 2, the panels 12, 13, 15 and 16 define a bottom opening 57 suitable for receiving a topmost portion of a conventional step ladder 58. The inverted bag shape formed by the panels 12–16 of tool carrying apparatus 10 are operatively adapted for being disposed over and around a top-most portion of the conventional step ladder 58. In this way, with the panels 12–16 permanently joined together, the apparatus 10 must be lifted up and over the top rung of the ladder 58 before apparatus 10 will fall off of the ladder 58. Once apparatus 10 is secured to the top of the ladder 58 in this manner, the risk of the tools accidentally falling off of the ladder 58 is significantly reduced, if not eliminated. In addition, because the tools (not shown) are mounted to the ladder 58, a worker 60 is relatively unencumbered by the weight of the tools, as would be the case if a conventional tool belt (not shown) were used.

Figure 3:
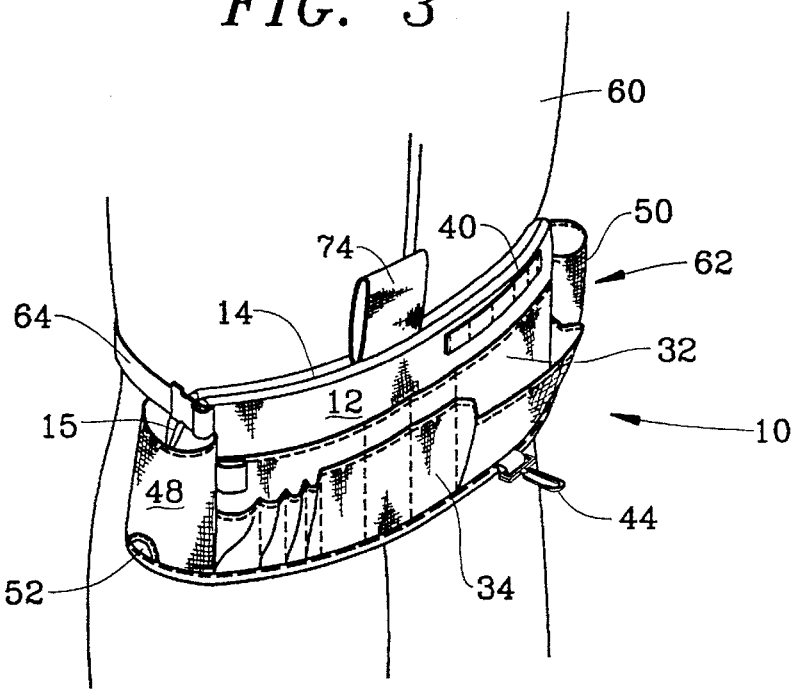
FIG. 3 is a perspective view of the apparatus of FIG. 1, secured around a person's waist for use as a tool belt.

The tool carrying apparatus 10 can be converted into a tool belt 62 by folding the top panel 14 along a fold line 64, corresponding to its central longitudinal axis, bringing the front and back panels 12 and 13 adjacent to one another. Each side panel 15 and 16, and its corresponding pocket 48 and 50, are also folded generally in half. In this way, the apparatus 10 can be flattened to conform around the waist of a worker 60 (see FIG. 3). A belt 64 is used to secure the now folded apparatus 10 around the worker's waist. The apparatus 10 has a male and female plug-in connector 66 and 68, one sewn on either side of the front panel 12. The belt 64 has corresponding female and male connectors which couple with connectors 66 and 68 to form the tool belt 62. Belt 64 can also be used as a shoulder strap. In addition, connectors 66 and 68 can be positioned wherever desired, including anywhere along seams 28 and 30, respectively, on either end of top panel 14.

Two pairs of mating snaps 70 and 72 are riveted onto the face of the top panel 14. When the top panel 14 is folded along line 64 to form tool belt 62, the fasteners 70 and 72 of each pair are snapped together to help maintain panel 14 in its folded condition. Rather than using male and female snaps 70 and 72, other suitable fasteners can also be used, for example a hook and loop fastener (e.g., VELCRO™), buttons, hooks, etc. A carrying strap 74 is also sewn onto top panel 14 transversely across its face. Strap 74 can be used to help pull apparatus 10 off of and lower apparatus 10 on to the ladder 58. Strap 74 can also be used in carrying apparatus 10 from one location to another.

From the above disclosure of the general principles of the present invention and the preceding detailed description, those skilled in this art will readily comprehend the various modifications to which the present invention is susceptible. For example, apparatus 10 can include an opening 76 (shown in phantom) formed through each side panel 15 and 16. When apparatus 10 is used as a tool belt 62, the belt 64 could be extended into one opening 76, across apparatus 10, out the other opening 76 and around the waist of the worker 60. Alternatively, one or more belt loops could be sewn across apparatus 10, for example across the top of front panel 12. In this way, the apparatus 10 can be secured to and removed from a separate belt (not shown), including the worker's own belt. The belt 64 could also be made an integral part of the tool carrying apparatus 10 itself. For example, a middle portion of the belt 64 can be fixed in a suitable manner (e.g., sewn, glued, stapled, riveted, etc.)

across the apparatus 10, such as across the top of the front panel 12 or across the top panel 14.

Therefore, the scope of the invention should be limited only by the following claims and equivalents thereof.

What is claimed is:

1. A tool carrying apparatus comprising:

a front panel having two sides, a top, a bottom and a face with a plurality of tool receiving pockets disposed thereon;

a back panel having a face, two sides, a top and a bottom, with one side of said back panel being connected to one side of said front panel and the other side of said back panel being connected to the other side of said front panel so as to form a plurality of panels operatively adapted for being disposed around a top portion of a ladder;

a plurality of side panels, with one side of said front panel being connected to one side of said back panel by a side panel and the other side of said front panel being connected to the other side of said back panel by another side panel, each said side panel having a face, two sides, a top and a bottom, with one side of each said side panel being joined to one side of said front panel, and the other side of each said side panel being joined to one side of said back panel, each said side panel being foldable to allow said front panel to be adjacent said back panel when said apparatus is used as a tool belt;

a ladder securing means for securing said plurality of panels around the top portion of the ladder; and a belt securing means for securing at least one panel of said apparatus to a belt, wherein said tool carrying apparatus is convertible between being used as a ladder caddy and as a tool belt.

2. The tool carrying apparatus of claim 1, said plurality of tool receiving pockets disposed on said front panel being operatively adapted to accommodate different types of tools.

3. The tool carrying apparatus of claim 1, the face of at least one of said back and side panels having at least one tool receiving pocket disposed thereon.

4. The tool carrying apparatus of claim 1, said plurality of panels being operatively adapted for being disposed over and around a top portion of a ladder.

5. The tool carrying apparatus of claim 1, said ladder securing means comprising at least one strap connecting the top of said front panel and the top of said back panel so as to prevent said plurality of joined panels from sliding down the ladder when disposed around the top portion thereof.

6. The tool carrying apparatus of claim 1, said belt securing means comprising two belt fasteners operatively adapted for being secured to a belt, with one of said fasteners being disposed adjacent each side of one of said back panel and said front panel.

7. The tool carrying apparatus of claim 1, further comprising a belt for securing said apparatus to a person having a torso, and said belt securing means comprising at least one belt loop portion of said apparatus defining an opening through which said belt is disposed so as to extend from side-to-side across said plurality of panels and around the torso when said apparatus is used as a tool belt.

8. The tool carrying apparatus of claim 1, further comprising a belt, and wherein said belt securing means comprises a portion of said belt being fixed to at least one panel of said apparatus.

9. The tool carrying apparatus of claim 8, said belt being fixed to said at least one panel and operatively adapted so as to be useful as either a belt or a shoulder strap.

10. The tool carrying apparatus of claim 1, said ladder securing means comprising at least one top panel connecting the top of said front panel and the top of said back panel so as to prevent said plurality of joined panels from sliding down the ladder when disposed around the top portion thereof.

11. The tool carrying apparatus of claim 10, said at least one top panel having a face with a carrying strap disposed thereon.

12. The tool carrying apparatus of claim 10, said at least one top panel being foldable to allow said front panel to be adjacent said back panel when said apparatus is used as a tool belt.

13. The tool carrying apparatus of claim 12, further comprising at least one fastener for maintaining said at least one top panel in a folded condition.

14. A tool carrying apparatus comprising:

a front panel having two sides, a top, a bottom and a face with plurality of tool receiving pockets disposed thereon, each of said pockets being operatively adapted to receive a different type of tool;

a back panel having two sides, a top, a bottom and a face with at least one tool receiving pocket disposed thereon;

a first and second foldable side panel, each said side panel having two sides, a top, a bottom and a face with at least one tool receiving pocket disposed thereon, one side of said first side panel being joined to one side of said front panel, the other side of said first side panel being joined to one side of said back panel, one side of said second side panel being joined to the other side of said front panel and the other side of said second side panel being joined to the other side of said back panel so as to form a plurality of panels operatively adapted for being disposed over and around a topmost portion of a ladder;

at least one foldable top element connecting the top of said front panel and the top of said back panel so as to prevent said plurality of panels from sliding down the ladder when disposed around the topmost portion of the ladder;

a belt; and at least one belt fastener operatively adapted for securing at least said front panel to said belt, wherein said tool carrying apparatus is convertible between being used as a ladder caddy and as a tool belt.

15. A tool carrying apparatus comprising:

a front panel having two sides, a top, a bottom and a face with a plurality of tool receiving pockets disposed thereon;

a back panel having a face, two sides, a top and a bottom, with one side of said back panel being connected to one side of said front panel and the other side of said back panel being connected to the other side of said front panel so as to form a plurality of panels operatively adapted for being disposed around a top portion of a ladder;

a plurality of straps, with one side of said front panel being connected to one side of said back panel by at least one strap and the other side of said front panel being connected to the other side of said back panel by at least one other strap;

a ladder securing means for securing said plurality of panels around the top portion of the ladder; and a belt securing means for securing at least one panel of said apparatus to a belt, wherein said tool carrying apparatus is convertible between being used as a ladder caddy and as a tool belt.

16. A tool carrying apparatus comprising:

a front panel having two sides, a top, a bottom and a face with a plurality of tool receiving pockets disposed thereon;

a back panel having a face, two sides, a top and a bottom, with one side of said back panel being connected to one side of said front panel and the other side of said back panel being connected to the other side of said front panel so as to form a plurality of panels operatively adapted for being disposed around a top portion of a ladder;

a ladder securing means for securing said plurality of panels around the top portion of the ladder, said ladder securing means comprising at least one strap connecting the top of said front panel and the top of said back panel so as to prevent said plurality of panels from sliding down the ladder when disposed around the top portion thereof; and a belt securing means for securing at least one panel of said apparatus to a belt, wherein said tool carrying apparatus is convertible between being used as a ladder caddy and as a tool belt.

17. A tool carrying apparatus comprising:

a front panel having two sides, a top, a bottom and a face with a plurality of tool receiving pockets disposed thereon;

a back panel having a face, two sides, a top and a bottom, with one side of said back panel being connected to one side of said front panel and the other side of said back panel being connected to the other side of said front panel so as to form a plurality of panels operatively adapted for being disposed around a top portion of a ladder;

a ladder securing means for securing said plurality of panels around the top portion of the ladder, said ladder securing means comprising at least one top panel connecting the top of said front panel and the top of said back panel so as to prevent said plurality of joined panels from sliding down the ladder when disposed around the top portion thereof, said at least one top panel having a face with a carrying strap disposed thereon; and a belt securing means for securing at least one panel of said apparatus to a belt, wherein said tool carrying apparatus is convertible between being used as a ladder caddy and as a tool belt.

18. A tool carrying apparatus comprising:

a front panel having two sides, a top, a bottom and a face with a plurality of tool receiving pockets disposed thereon;

a back panel having a face, two sides, a top and a bottom, with one side of said back panel being connected to one side of said front panel and the other side of said back panel being connected to the other side of said front panel so as to form a plurality of panels operatively adapted for being disposed around a top portion of a ladder;

a ladder securing means for securing said plurality of panels around the top portion of the ladder;

a belt for securing said apparatus to a person having a torso; and a belt securing means for securing at least one panel of said apparatus to said belt, said belt securing means comprising at least one belt loop portion of said apparatus defining an opening through which said belt is disposed so as to extend from side-to-side across said plurality of panels and around the torso when said apparatus is used as a tool belt wherein said tool carrying apparatus is convertible between being used as a ladder caddy and as a tool belt.

* * * * *